US006822174B1

(12) United States Patent
Spies

(10) Patent No.: US 6,822,174 B1
(45) Date of Patent: Nov. 23, 2004

(54) DEVICE FOR ACTIVATING AN OPENING OR CLOSING MECHANISM FOR LOCKABLE MOVING PARTS ON VEHICLES

(75) Inventor: Wolfgang Uwe Spies, Haan (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/661,272

(22) Filed: Sep. 13, 2003

Related U.S. Application Data

(62) Division of application No. 10/009,033, filed as application No. PCT/EP00/03983 on May 4, 2000, now Pat. No. 6,696,652.

(30) Foreign Application Priority Data

May 18, 1999 (DE) ..... 199 22 657
Dec. 18, 1999 (DE) ..... 199 61 246

(51) Int. Cl.[7] ..... H01H 35/00; H01H 3/00

(52) U.S. Cl. ..... 200/52 R; 200/61.58 R; 200/329

(58) Field of Search ..... 200/52 R, 61.58 R, 200/61.62, 329–333, 302.1, 302.2, 5 R, 5 A, 6 A

(56) References Cited

U.S. PATENT DOCUMENTS 3,654,415 A * 4/1972 Hawkins et al. ..... 200/332.2
4,713,509 A * 12/1987 Chebowski ..... 200/333
5,448,028 A * 9/1995 Filion et al. ..... 200/52 R
5,489,754 A * 2/1996 Dirmeyer et al. ..... 200/302.2
5,498,844 A * 3/1996 Chan ..... 200/330
5,784,891 A * 7/1998 Lee ..... 200/333
6,696,652 B1 * 2/2004 Spies ..... 200/61.62

FOREIGN PATENT DOCUMENTS

DE 4213084 A * 1/1993
GB 2161122 A * 1/1986
WO WO9711473 A * 3/1997

OTHER PUBLICATIONS

International Search Report, PCT/EP00/03983, mailed Aug. 14, 2000, 3 pages (pp. 37–39 of PCT publication).*

* cited by examiner

*Primary Examiner*—James R. Scott
(74) *Attorney, Agent, or Firm*—Friedrich Kueffner

(57) ABSTRACT

A device for activating an opening mechanism and/or closing mechanism for lockable movable parts on vehicles includes a manual actuator which in the activating situation acts on at least one contact maker of at least one switch, wherein the actuated switch switches on a drive for opening or closing the movable part. A car body has a wall thickness which is rigid in itself and non-compressible, but a free car body portion is of such a large size relative to an adjoining substantially shape-stable neighboring area of the car body that, when exerting a pressure, this car body portion will form a dent by a travel stroke and this dent serves for actuating the switch.

1 Claim, 7 Drawing Sheets

DEVICE FOR ACTIVATING AN OPENING OR CLOSING MECHANISM FOR LOCKABLE MOVING PARTS ON VEHICLES

CROSS-REFERENCE TO RELATED APPLICATION

This application is a divisional application of U.S. patent application Ser. No. 10/009,033, now U.S. Pat. No. 6,696,652, filed Oct. 8, 2001 which is a 371 of PCT/EP00/03983 filed May 4, 2000.

The invention relates to a device for activating an opening mechanism and/or a closing mechanism for lockable moving parts on vehicles. The device includes a manual actuator which, upon its actuation, acts on a switch and switches on a drive for opening or closing the movable vehicle part. Such a drive can belong to a closure which is embodied as a rotary latch. The rotary latch is secured by a locking pawl in the locking position and, upon activating the actuator, is transferred into an opening position. Such a device is, for example, used at the rear hatch of a motor vehicle.

DESCRIPTION OF THE RELATED ART

In the known device of this kind (DE 34 40 442 A1) the actuator is a pushbutton which is arranged in a hole in the outer skin. In order to secure the pushbutton in its initial position, a pressure spring is required. In order to protect the mechanism against dirt and moisture, the pushbutton is covered by a foil and sealed. Upon actuating the pushbutton, a ball is moved which acts on a contact maker of a switch which is arranged adjacent to the pushbutton. This known actuator comprises several components which must be manufactured separately and assembled with one another. Despite the elastic cover, dirt and moisture can enter the hole of the outer skin.

Moreover, in devices of the kind mentioned above, further decorative elements, can be provided before, on and/or within the outer skin of the vehicle which serve for embellishing or provide a visual information content. A typical example for this is a company emblem.

In a device of the latter kind (DE 197 22 503 A1) the decorative element is comprised of a company emblem which is supported rotatably on the outer skin which in its initial position covers a lock body relative to the exterior. The company emblem can be transferred into a release position in which it releases the lock body or another actuator for the vehicle part. In the release position, the company emblem at the same time functions as a grip element in order to completely open the vehicle part, for example, a rear hatch of the vehicle. After actuation of the means, it was necessary to return the company emblem into its initial position. This is cumbersome.

It is known to arrange push buttons for interior gauges of motor vehicles under an elastic plastic skin (DE 42 13 084 A1) and to actuate the switches through the skin. The elastic skin serves as a cover of the steering wheel or an arm rest in the vehicle interior. Such a plastic skin cannot be used for the external actuation of doors or flaps of a vehicle. The external actuator of a door must be able to withstand impacts and must be weathering resistant.

It is moreover known to employ for actuation of switches in an arm rest (WO 97/11473) pressure-responsive resistors which are connected to a control module. The pressure-responsive resistors are arranged on the surface of a foam material layer and the foam material layer is covered by a flexible skin which may have a soft outer layer. Upon pressure actuation on the flexible skin, the foam material layer is compressed and this results in a thickness change of the soft cover positioned above the pressure-responsive resistors. Such soft inner covers of the vehicles are not suitable for external actuators of doors.

It is finally also known in the case of inner covers of vehicles (GB 2 161 122 A) to employ membrane switches underneath an elastic foam material layer, wherein the arrangement locations of the switch, for the purpose of visual and touch recognition, are recessed at some locations. The actuation pressure results in a deformations of the recessed locations of the foam material layer which then act on the membrane switch. Such foamed material layers have also been used for rocker actuators or membrane switches (U.S. Pat. No. 5,448,028), wherein projecting areas in the arm rest indicated the position of the switch. This foam material layer was covered by a flexible skin. The pressure actuation resulted in the compression of the layer above the membrane switch or the rocker with regard to its layer thickness which resulted in pressure being exerted onto the switching elements underneath. Such foam material layers which are compressible with regard to their layer thickness are not suitable for the external actuation of doors.

Cushions of elastic material, whose exterior however must be covered by a metallic coating, have been used on the grips or buttons positioned on the exterior side of doors (FR 2 217 784 A). In the elastic cushions a switch with a contact maker was integrated. The contact maker was supported on a bracket arranged before the cover. The car body of the door in this area was provided with a depression in order to provide space for the hand. The hand compressed the elastic cushion from behind, i.e., from the interior of the depression. Accordingly, the cushion together with the switch integrated therein was pressed against the bracket underneath the cover. This door actuators are comprised of numerous components. This known door actuators form disturbing components projecting from the car body which can easily soil and are difficult to clean.

SUMMARY OF THE INVENTION

The invention has the object to provide a reliable device of the kind mentioned above which is of an inexpensive configuration and is easy to manipulate.

The invention has recognized that either the outer skin of the vehicle or the decorative element seated on the exterior skin of the vehicle can take over the further novel functions of being the actuator for the switch. According to a first embodiment, a portion of the car body itself is used as an actuator for the switch. The car body is comprised generally of sheet metal. The wall thickness of the car body cannot be compressed but is rigid by nature. The invention suggests to size a car body portion so large relative to the supported neighboring areas of the car body that this portion can be pushed inwardly from an initial position by a certain travel stroke to form a dent. This dent is used for actuating a switch. The car body is outwardly smooth within this dented portion, requires no holes and no insert parts. It is sufficient to arrange the contact maker of the switch either directly or indirectly in the yielding path of the car body portion. Since holes are no longer present in the car body, there are no sealing problems and there is no risk of soiling.

In an analog way, according to another embodiment, a portion of the decorative element is the actuator for the switch without this requiring special measures. The provided configuration of the decorative element in the form of stays and intermediate penetrations is used. Such stays result because of the decorative function or its information contents upon which the decorative element is based, for xample, by the lines of a letter. The invention has recognized that the stays generate the elastic yielding in a certain portion of the decorative element and that this area is especially suitable in order to serve as an actuator for the switch. At most, separating cuts or weakening of these stays must be additionally provided. These separating cuts and weakened areas do not interfere with the decorative function nor do they change the information content; for example, a letter remains easily readable even when the line forming its stay has a small gap. The gap transforms the stay into a bar which is fastened at one end and free at the other end which upon pressure exertion can be easily bent. Accordingly, numerous components, which were otherwise required for an actuator positioned underneath the decorative element, are no longer needed. Moreover, the decorative element as a whole must not at all change its initial position in order to trigger the actuator. It is sufficient to push the respective stay of the decorative element in order to obtain the desired switch actuation.

BRIEF DESCRIPTION OF THE DRAWINGS

Further features and advantages of the invention result from the dependent claims, the following description, and the drawings. In the drawings, the invention is illustrated in several embodiments. It is shown in:

DETAILED DESCRIPTION OF THE PREFERRED EMBODIMENTS

Figure 1:
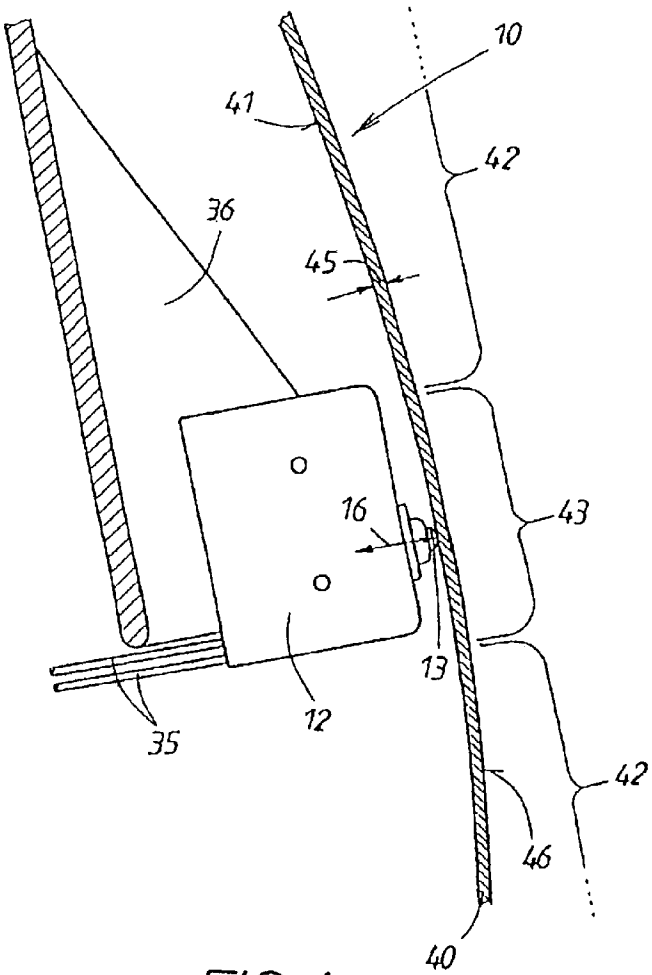
FIG. 1 a longitudinal section of a portion of the outer skin of a vehicle with the actuating location according to the invention, shown in the rest position.

FIG. 1 shows in a longitudinal section a portion of a rear hatch 10 of the motor vehicle which is secured by a lock, not shown in detail, in the closed position. In order to facilitate opening of the lock, a drive, not illustrated in detail, is provided, for example, an electric motor. For switching on or off this drive, a switch 12 is provided which is connected by lines 35 with the drive. In the usually present closed position of FIG. 1 the drive is inactive. The switch 12 is fastened on a support 36 which is integrated into the structure of the hatch 10 in this configuration. A contact maker 13 of the switch 12 is arranged on the backside 41 of the outer skin 40 and should be, if possible, in contact with the backside 41. The contact maker 13 in the present case is comprised of a pin which is longitudinally movable in the direction of arrow 16 and, according to its movement, can perform different switching functions within the switch 12. When the pin 13 is pushed in, the contacts within the switch 12 are closed, and a corresponding switch-on signal is transmitted via lines 35 to the drive.

Several switches 12 can be provided at this location or in the neighboring area which are correlated with further functions in the vehicle, for example, for closing the closure when closing the rear hatch. Such switches 12 can also activate additional functions on the vehicle, such as closing or opening of the doors, the windows and the sliding roof of a vehicle. These different functions can alternatively also be triggered by different magnitudes of the pushing-in movement 16 of the contact maker 13. Between the contact maker 13 of the switch 12 and the backside 41 of the skin, it is also possible to arrange transmission members for the switch actuation so that the switch 12 itself could be fastened at a more beneficial location relative to the outer skin 40 which location is moved farther away.

Figure 2:
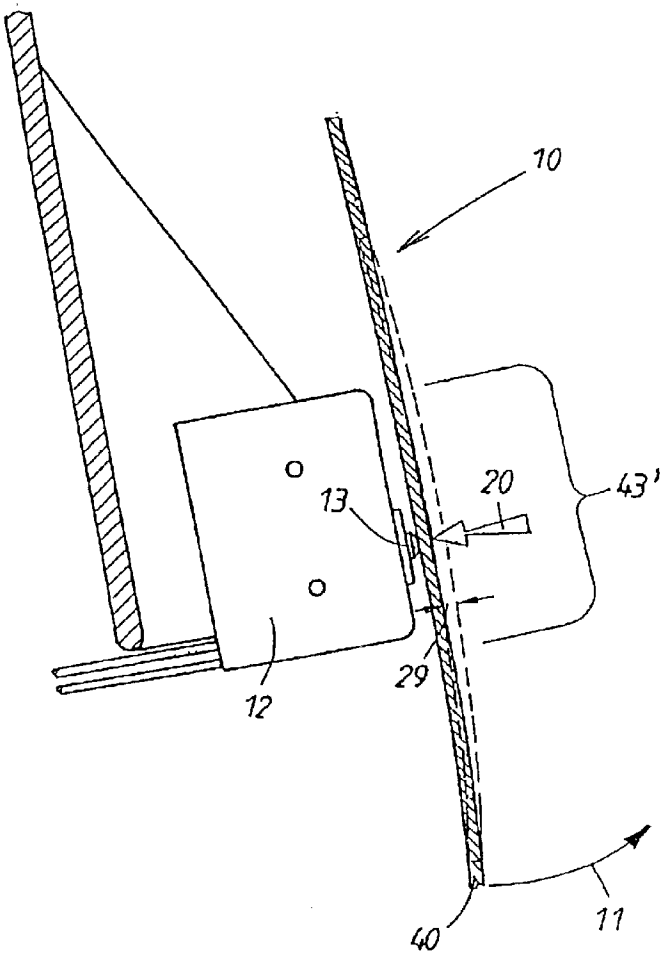
FIG. 2 the device illustrated in FIG. 1 in the situation of pressure actuation.

The location 43 of the outer skin 40 which is substantially aligned with the contact maker 13 is elastically deformable relative to the adjoining neighboring area 42 when pressure is exerted there according to the force arrow 20 of FIG. 2. For short, this location 43 will therefore be referred to in the following as "deformation location" of the outer skin 40. The actuation situation of the deformation location is illustrated in FIG. 2 and the deformation resulting therefrom is indicated at 43'. The yielding path, indicated in FIG. 2 at 29, results in which the contact maker 13 is arranged directly, as mentioned before. The drive is then activated in the described way. The rear hatch 10 can be transferred in the direction of movement arrow 11 of FIG. 2 into the upwardly folded position, not illustrated in detail.

The deformation location 43 is suitably embodied such that upon pressure actuation 20 a defined yielding action is realized. This can be realized by a corresponding shaping of the location 43 and/or by a reduction of the wall thickness 45 of this outer skin 40. Also, weakening of this deformation location 43 by cutouts in the wall of the outer skin 40 would be conceivable. The center of the deformation location 43, which is especially effective for the exertion of the pressure 20, should be marked in a special way at the exposed side 46 of the outer skin 40. The drive, in the actuation situation of the deformation location 23', can be used for a complete opening of the rear hatch 10 without this requiring an auxiliary manual handling. This should also apply in the case of the other embodiments.

Figure 3:
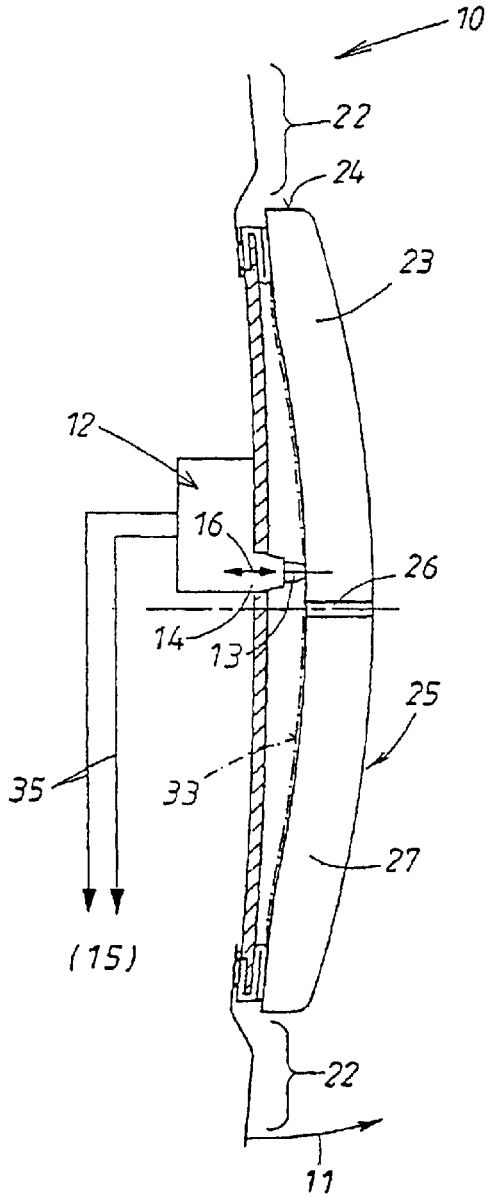
FIG. 3 a first alternative embodiment of the invention, i.e., a longitudinal slot through a portion of a rear hatch of a motor vehicle, shown in the rest position.
Figure 4:
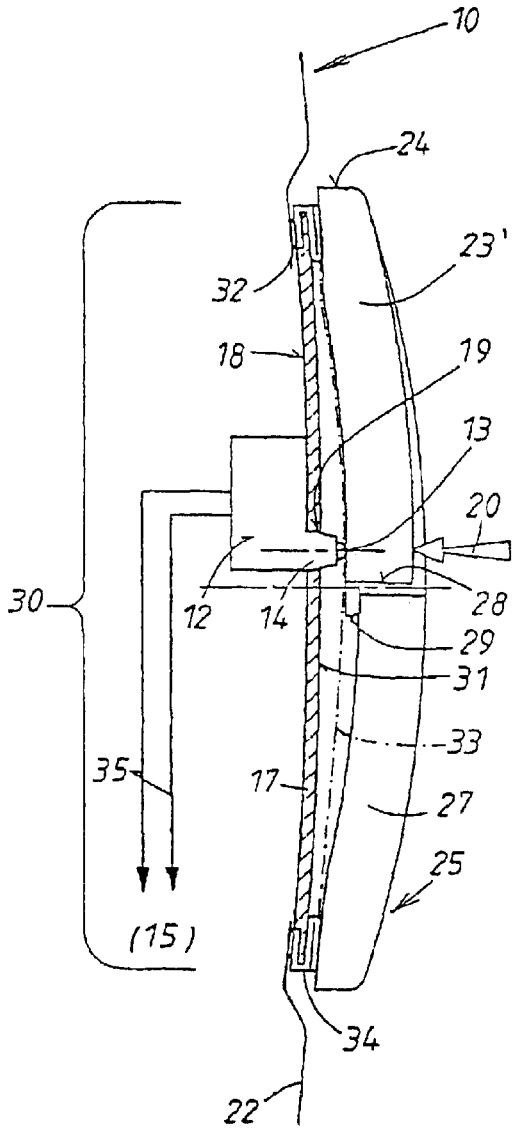
FIG. 4 the device illustrated in FIG. 2 in the actuating situation.

The embodiment according to FIGS. 3 and 4 shows a modification of the lock wherein for identifying corresponding components the same reference numerals as in the preceding embodiment of FIGS. 1 and 2 are used. In this connection, the previous description applies. It is sufficient to discuss the differences.

The actuator for the switch in the present case is a company mblem 25 with a circular contour 24 which has an elastically deformable portion 23. The company emblem 25 has a logo which is comprised of several stays 23, 27. The stays 23, 27 fulfill a certain decorative function and can also provide a visual information content and can be comprised of letters and/or an image. Between the stays there are penetrations. In the present embodiment there is even a separating cut 26 between two stays 23, 27 which make one stay 23 flexible. The stay 23 is fast at one end in the circumferential area 24, but is flexible at its oppositely positioned free end 28. The stay 23 fulfills the function of a flexible bar. It is deformed in the direction of arrow 20" of FIG. 4 relative to the neighboring stay 27, which is in itself rigid, toward the switch 12 and reaches the position 23'. This is illustrated in FIG. 4 by the deformation travel 29. The company emblem is integrated into a neighboring area 22 of the car body.

As can be seen in FIG. 4, the company emblem 25 belongs to a modular unit 30 which in itself can be completely pre-assembled and comprises the following components. There is first a mounting plate 17 on whose backside 18 the already mentioned microswitch 12 with its housing is fastened. A guide 14 on the switch housing penetrates a penetration 19 provided within the mounting plate 17 so that the contact-providing pin 13 is positioned at the inner side 31 of the mounting plate 17. In front of the contact pin 13 a continuous elastic membrane 33 can be arranged, which is illustrated in FIGS. 3 and 4 only by a dash-dotted line and which is a component of the modular unit 30 and extends over the entire inner side 31 of the plate in a sealing way. The company emblem 25, together with the membrane 33 and a circumferential seal 34, is fixedly connected to the mounting plate 17, for example, by screws. Of course, these fastening screws do not impair the flexibility of the afore described yielding location 23. This modular unit 30 is mounted in the aforementioned neighboring area 22 of the outer skin in a cutout 32, illustrated in FIG. 4.

When the force exertion 20 of FIG. 4 is finished, the elasticity within the company emblem 25 ensures that the car body location returns from its actuating position 23' again into its initial position of FIG. 3. This restoring movement can be supported, if needed, also by additional elastic means such as leaf spring. Normally, this is not required, in particular, because the membrane 33 has a certain restoring elasticity. The membrane 33 has in fact the tendency to return into the curved position illustrated in FIG. 3 which is its stable state.

It is understood that, instead of a company emblem 25, other decorative elements on the outer skin of the vehicle can take over the function of the inventive actuator for a microswitch. For example, it is possible to use decorative parts of a vehicle for this purpose. However, suitable would be also designation parts on the vehicle which are provided anyway, for example, the model designation of the vehicle.

Figure 5:
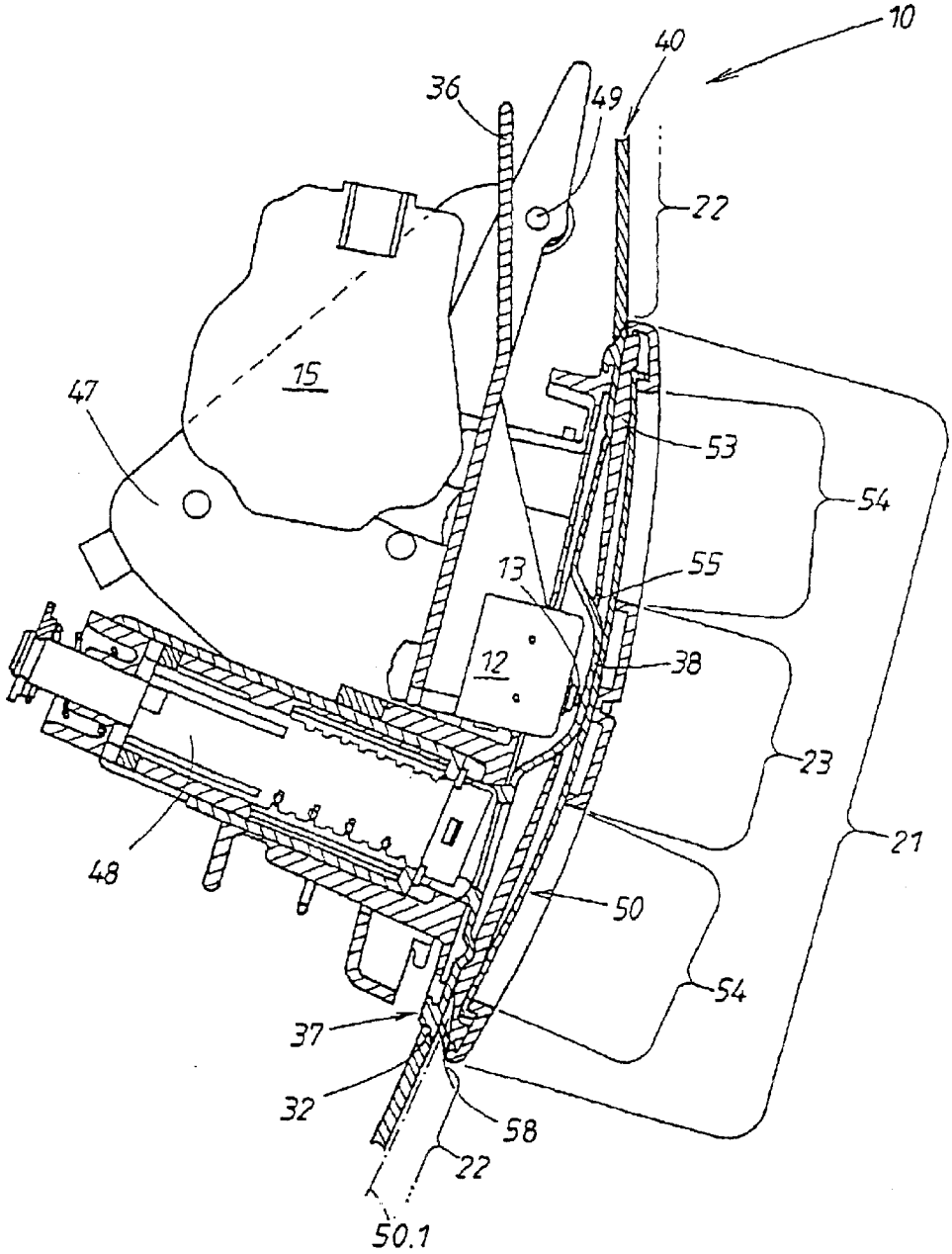
FIG. 5 a further embodiment of the device according to the invention, where the actuatable deformation location is integrated into a company emblem which is seated on the outer skin of a rear hatch of the vehicle, shown in a rest position.
Figure 6:
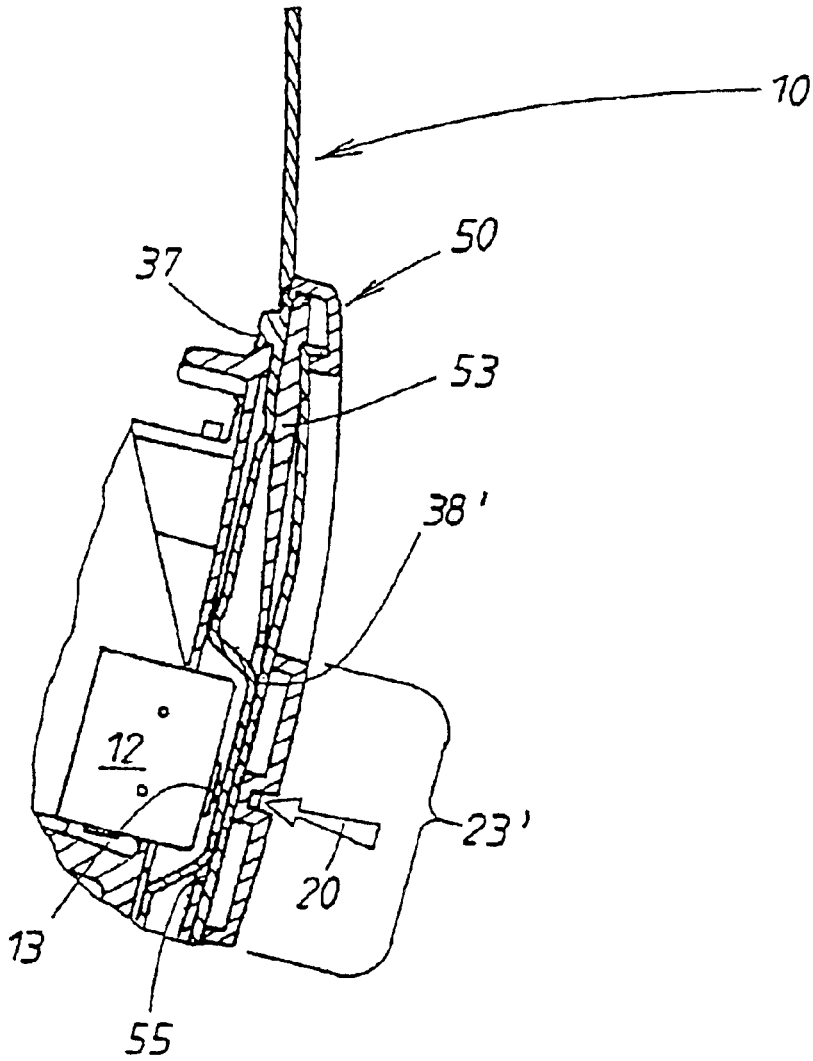
FIG. 6 a detail of the device shown in FIG. 5 during its pressure actuation.
Figure 7:
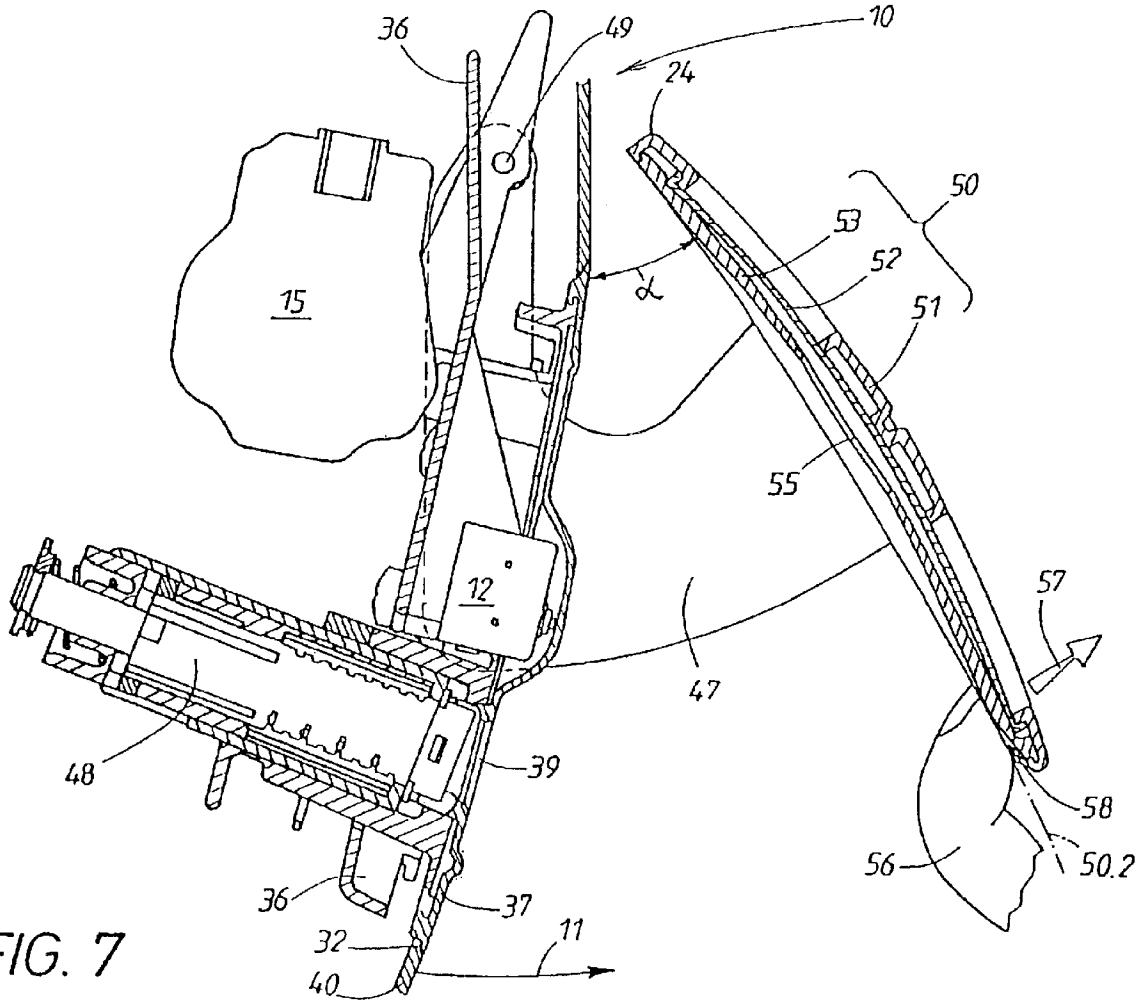
FIG. 7 the spaced position of the company emblem resulting from the pressure actuation of FIG. 6 and now serving as a hand grip for completely opening the flap.

In the third embodiment of FIGS. 5 through 7, a modular unit 21 comprised of an attachment 50 and an insert 37 is provided, wherein a company emblem 51 is integrated also in the attachment 50. This modular unit 21 is pre-manufactured and mounted in the neighboring area 22 of the car body. In contrast to the preceding embodiment of FIGS. 3 and 4, the company emblem 51 integrated into the attachment 50 is movable by the same motor 15 which also serves for actuating the lock which is not illustrated in detail. FIG. 7 shows the spaced position 50.2 where the attachment 50 has an angle $\alpha$ of approximately 45° relative to the contact position 50.1 in FIG. 5.

The insert 37 on the other hand remains stationary. It forms the inner layer of this modular unit 21, is comprised of elastomeric material, and is seated in a cutout 32 of the outer skin 40. This inner layer 37 forms an elastic seal and has a central dome 38 in front of the contact maker 13 of a switch 12 which is seated on the support 36. In a spaced position according to FIG. 7, a closing cylinder 48, which in an emergency situation allows for a key actuation of the rear hatch lock, is accessible through an opening 39 in the inner layer 37. The closing cylinder 48 is mounted on the support 36. On the support 36 two levers 47 are connected at 49. The levers 47 support the attachment 50.

As can be taken best from FIG. 7, the attachment 50 itself is of a multi-layer configuration comprised of the outer company emblem 51, a membrane 52 arranged at the backside thereof and having elasticity of extension, and a shape-stiff grip plate 53 which is comprised of metal. The company emblem 51 is comprised of a relatively shape-stable material, i.e., plastic, but has penetrations 54 which provide in the central area of this outer layer 51 a sufficient elasticity of flexure. The company emblem 51 is three-dimensional and has penetrations 54 in the relief between the lettering and the image. The penetrations 54 are closed at the backside by the expandable membrane 52 and are thus sealed. The grip plate 53 positioned underneath is seated on the free ends of the levers 47 and has a hole 55 at a defined location. The three layers 51, 52, 53 of the attachment 50 are fixedly connected to one another at their periphery 24. At the central area of the attachment 50 a sufficient spacing is provided between the grip plate 53 and the flexible layers 51, 52 positioned above.

Normally, the contact position 50.1, which is indicated in FIG. 5 by an auxiliary line 50.1, is present where the modular unit 21 is positioned closely at the inner layer 37 within the cutout 32 of the outer skin 40. In this case, the central dome 38 of the elastic inner layer 37 projects through the hole 55 of the grip plate and, as illustrated in FIG. 5, is aligned with a yielding location 23 of the company emblem 51. The yielding action is recognizable for the pressure actuation 20 illustrated in FIG. 6. In the company emblem 51 the yielding location 23 is transferred into the pushed-in position 23' illustrated therein where the dome of the elastic inner layer 37 positioned behind has been pushed into the area of the grip plate hole 55 and thus has suffered a flattening 38'. Accordingly, the contact maker 13 is pushed in and the switch 12 actuated. The grip plate 53 limits the pressure actuation 20 of the actuated deformation location 23' according to FIG. 4.

The actuation of the switch 12 activates the drive 15 by means of an electronic control, not illustrated in detail, which drive, as mentioned already above, first transfers the lock of the rear hatch 10 into a ready position for opening. The same motor drive 15, expediently after a short delay, is also used for movement of the modular unit 50. This movement is realized via the levers 47 which are pivoted outwardly. This results in the already aforementioned spaced position of FIG. 7 which is indicated therein by the auxiliary line 50.2. Now the grip plate 53 can be engaged from behind by a human hand 56 in order to transfer the rear hatch 10 in the direction of movement arrow 11 of FIG. 7 into the completely open position. For this purpose, the opening force which is illustrated by the force arrow 57 is provided.

From its spaced position 50.2 the modular unit 50 is returned manually or by a motor drive into its contact position 50.1 of FIG. 1. This can also be performed automatically upon closing of the rear hatch.

The device according to FIGS. 3 to 5 could also be integrated as an immobile attachment 50 or as an insert into the outer skin 40 when the function of a hand grip according to FIG. 5 is not to be utilized. In this case, the grip plate 53 and the lever 47 can be eliminated. However, the outer layer 51 as the company emblem remains in place behind which sealing layers 52 and/or 37 are positioned and which acts through the actuating pressure 20 according to FIG. 4 in the already described way on the contact member 13 of the switch 12.

Should the electrical devices of the vehicle be defective and the switch 12 and the drive 15 therefore not be functioning, the rear hatch 10 can still be opened. The attachment 50 has, as illustrated in FIGS. 5 and 7, in the lower area a rearward cutout 58 which is accessible for the fingertips of a human hand. By a manual pulling action, the levers 47 can then be decoupled from a locking position coupled with the motor 15 and make possible a manual pivoting of the modular unit into the spaced position illustrated in FIG. 7. As already mentioned, the end face of the closing cylinder 48, which is normally positioned below the modular unit 50, is then accessible through the opening 39 of the inner layer 37 and makes possible the opening of the rear hatch, as already mentioned, by means of an emergency key.

Figure 8:
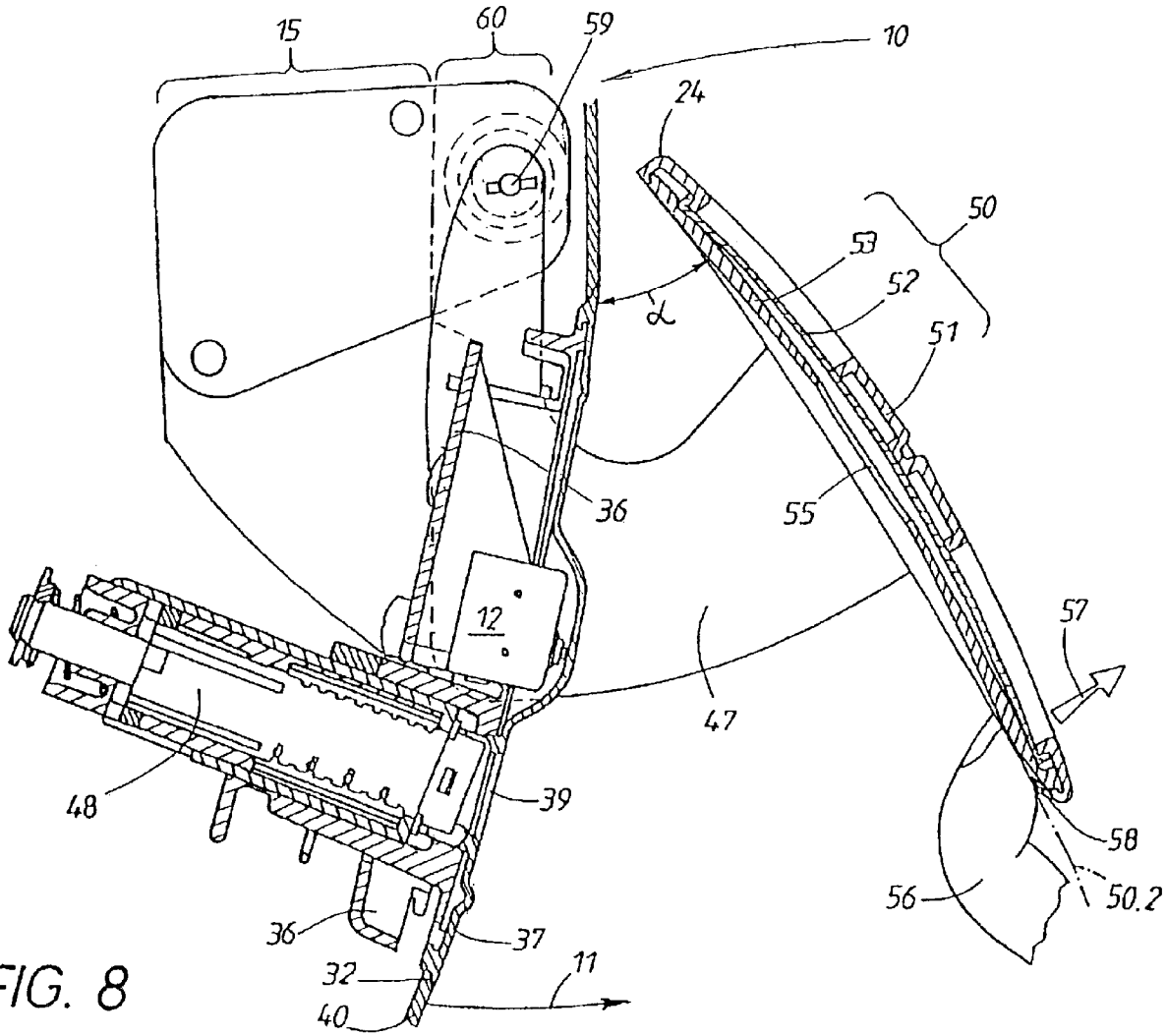
FIGS. 8–9 two modified embodiments of the device illustrated in FIGS. 5 through 7 when the company emblem is in a spaced position.

In FIG. 8 a modification of the device of FIGS. 5 through 7 is illustrated. It is sufficient to only discuss the differences while in other respects the description provided above applies. In this case the levers 47 are connected fixedly to a bearing shaft 59 for common rotation. The shaft 59 is driven by a transmission 16 which is arranged downstream of the motor 15.

The emergency situation described in the preceding embodiment can be applied also in this modification of FIG. 8. In this case, between the bearing shaft 59 and the transmission 60 a locking coupling is provided which can be, for example, a magnetic coupling which acts by means of permanent magnets. By exerting a sufficiently great opening force, the magnetic coupling is decoupled and the levers 47 reach a "freewheeling" position.

Figure 9:
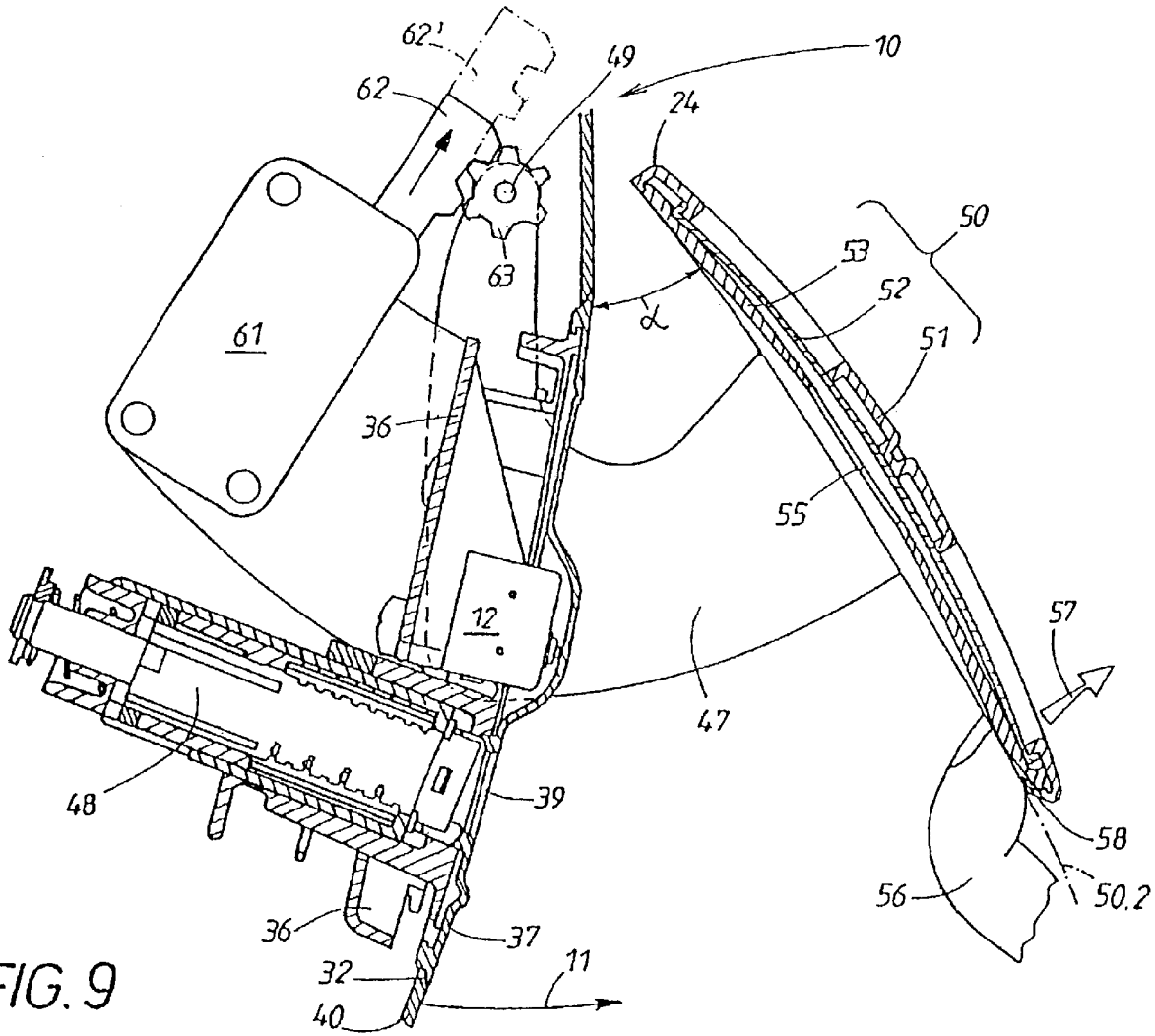

In the embodiment of FIG. 9, a drive 61, modified in comparison to FIG. 8, is illustrated which is comprised of a motor, in particular, an electric motor and a transmission. Here, the output member of the transmission is a tooth rack 62 which engages a gear wheel 63. The gear wheel 63 is fixedly connected with the levers 47 and pivotable together with them about their connecting location 49. FIG. 9 shows in solid lines the inserted position 62 of the tooth rack. Its retracted position 62' is illustrated in dash-dotted lines. It is present when the attachment 50 is positioned in the contract position illustrated in the second to last embodiment of FIG. 5. In this case, in an emergency situation it is possible to manually move away the attachment 50 from the outer skin 40. For this purpose, it is sufficient to employ a double tooth rack or to employ again the afore described magnet coupling between the movable transmission parts.

LIST OF REFERENCE NUMERALS

10 rear hatch (in closed position), movable vehicle part
11 movement arrow of 10 for opening
12 switch
13 contact maker of 12, longitudinally movable springy pin
14 guide for 13 in the switch housing
15 drive, electric motor for opening of 10
16 movement arrow of 13
17 mounting plate
18 backside of 17
19 penetration in 17
20 force arrow of 23
21 modular unit
22 neighboring area of 21
23 deformation location (in initial position)
23' pushed-in position of 23
24 periphery, circumferential connection between 51, 52, 53 of 50
25 company emblem in 21
26 separating cut between 23, 27
27 rigid portion of 21 or 25
28 free portion end of 23
29 yielding path of 23
30 modular unit of 17, 12, 33, 34, 21, 25
31 inner plate side of 17
32 cutout in 40
33 elastic membrane across 17
34 circumferential seal of 30
35 lines between 12, 15 (FIGS. 1, 2)
36 support for 12
37 insert, deformable inner layer
38 central dome of 37 (in initial position)
38' flattening of 38 in the actuation situation
39 opening in 37 for 48 (FIG. 5)
40 outer skin of 10
41 backside of 40 (FIGS. 1, 2)
42 neighboring area of 43 (FIGS. 1, 2)
43 deformation location of 40 in initial position
43' deformation of 43 in the actuation situation
45 wall thickness of 40
46 exposed side of 40
47 lever
48 closing cylinder
49 connecting location of 47 on 36
50 attachment comprised of 51, 52, 53
50.1 contact position of 50 (FIGS. 5, 6)
50.2 spaced position of 50 (FIG. 7)
51 company emblem, decorative element
52 membrane with elasticity of extension
53 shape-stiff grip plate
54 penetration in 51
55 hole in 53
56 human hand engaging from behind (FIG. 7)
57 opening for 10
58 cutout at the rear of 50 (FIGS. 5, 7)
59 bearing shaft of 47 (FIG. 8)
60 transmission (FIG. 8)
61 drive (FIG. 9)
62 tooth rack (inserted position)
62' retracted position of 62
63 gear wheel (FIG. 9)
$\alpha$ angular movement of 50 between 50.1, 50.2

What is claimed is:

1. Device for activating an opening mechanism and/or a closing mechanism for lockable movable parts (10) on vehicles, such as flaps (10), doors or the like, which in the opening situation allow access at least to certain areas within the interior of the vehicle, comprising a manual actuator which in the activating situation acts on at least one actuator (13) of at least one switch (12), wherein the actuated switch (12) switches on a drive for opening or closing the movable vehicle part (10) by opening or closing an electrical circuit providing power to the drive, and comprising a car body (40) on the vehicle or on the movable vehicle part (10), such as a door skin, the switch being arranged behind the body, wherein the car body (40) has a wall thickness (45) which is rigid in itself and non-compressible, but a free car body portion (43) of the car body (40) is of such a large size relative to an adjoining substantially shape-stable neighboring area (42) of the car body, wherein—when exerting a pressure (20)—this car body portion (43) will form a dent (43') by a travel stroke (29) and this dent (43') serves for actuating the switch (12).

* * * * *